United States Patent [19]

Wolfe

[11] Patent Number: 4,508,242

[45] Date of Patent: Apr. 2, 1985

[54] TOOTHPASTE EXTRACTOR

[76] Inventor: Edward B. Wolfe, 500 Fairview Ave., Hyde Villa, Reading, Pa. 19605

[21] Appl. No.: 435,570

[22] Filed: Oct. 21, 1982

[51] Int. Cl.[3] ..... B65D 35/28

[52] U.S. Cl. ..... 222/102; 222/251

[58] Field of Search ..... 222/92, 95, 101, 102, 222/105, 98, 185, 96, 251

[56] References Cited

U.S. PATENT DOCUMENTS 4,418,840 12/1983 Gardner, Sr. ..... 222/102

FOREIGN PATENT DOCUMENTS 2443975 8/1980 France ..... 222/102

*Primary Examiner*—Stanley H. Tollberg
*Assistant Examiner*—Kenneth Noland
*Attorney, Agent, or Firm*—William Z. Warren

[57] ABSTRACT

The toothpaste dispensing apparatus of my invention comprises an enclosure which houses multiple separate tube holders for holding the tubes of paste. It, also, contains a reversible motor connected by a worm screw to a holder containing a pair of movable rollers for dispensing tooth paste, shaving cream, etc. from any of its multiple positions. The paste is discharged at the bottom of the inner tube holder by a squeezing pressure exerted upon the tube by the pair of rollers which moves downward over the inner tube holder. This device is equipped with a switch for automatically reversing the downward direction of the rollers when the contents of the tube have been exhausted. A most unique feature is the provision for housing several tubes and the selector knob, which allows the operator to choose either one of the several tubes on which to operate without having to dismantle or load or unload the device.

2 Claims, 3 Drawing Figures

TOOTHPASTE EXTRACTOR

BACKGROUND OF THE INVENTION

It is the purpose of this invention to provide a clean, simple and efficient device for applying dental paste to a toothbrush. This dispenser will also allow the family that has the need to use several types of paste to accomplish this need without any inconvenience, requiring only the push of a button and the turn of a knob. When the toothpaste tube has been completely exhausted, my device automatically causes the tube compressing means to reverse, thereby eliminating the need for an indicating means and for any overt act on the part of the operator.

Furthermore, this dispenser is electrical shock free, sturdy but light in weight, and inexpensive to build and repair.

Similar devices of the prior art are complicated in structure and operation and, having many moving parts, are not economical to manufacture or repair. Some devices lack an indicating means for making the operator aware of when all of the paste has been expelled from the tube. Even those devices which provide a means for indicating when the tube is fully collapsed require that the operator perform an operation to reverse the direction of the tube compressing means, usually rollers, in order to remove the exhausted tube. I am, also, not aware of any device which allows the operator to have the convenient choice of either of several different tubes of toothpaste or shaving cream, etc.

SUMMARY OF THE INVENTION

The toothpaste dispensing apparatus of my invention comprises an enclosure which houses multiple separate tube holders for holding the tubes of paste. It, also, contains a reversible motor connected by a worm screw to a holder containing a pair of movable rollers for dispensing tooth paste, shaving cream, etc. from any of its multiple positions. The paste is discharged at the bottom of the inner tube holder by a squeezing pressure exerted upon the tube by the pair of rollers which moves downward over the said inner tube holder. This device is equipped with a switch for automatically reversing the downward direction of the rollers when the contents of the tube have been exhausted. A most unique feature is the provision for housing several tubes and the selector knob, which allows the operator to choose either one of the several tubes without having to dismantle or load or unload the device.

The apparatus of the present invention is easy and economical to manufacture and offers a convenient and efficient mechanism for dispensing the contents of any of several collapsible tubes.

By virtue of the employment of a limited number of movable parts and gears, the incidence of malfunction and cost of manufacture and repair is greatly reduced.

Other objects and advantages of my invention will become more apparent after a careful study of the following detailed description taken together with the accompanying drawings which illustrate a preferred embodiment of my invention.

DESCRIPTION OF THE PREFERRED EMBODIMENT

Figure 1:
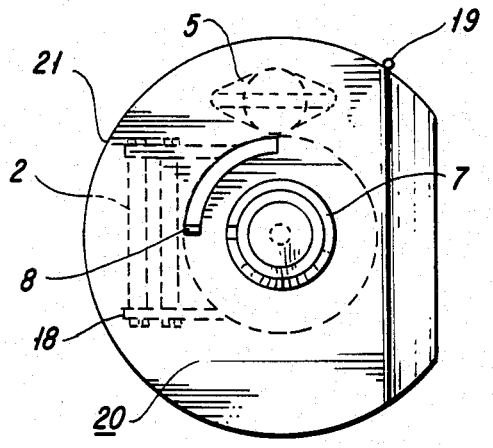
FIG. 1 is a top view, showing internal portions, of this invention.

Referring now more particularly to the drawings wherein is illustrated the preferred embodiment of my invention, in this case, a two-tube dispenser, FIG. 1, the top view, shows the life long plastic hinge (19), the plastic snap latch (20), and the main housing door (21). To open the door (21), the operator must apply a small amount of inward pressure along the snap latch (20) side and swing the door (21) to the left. When the door (21) is open, there will be exposed the two plastic tube holders (4), as shown in FIG. 3, which also each have a life long plastic hinge. The tubes of paste (5) are inserted by the operator into the holders (4); the holders (4) are then closed, as is the main door (21). The operator then chooses the desired tube of paste (5), by grasping the knob (7), see FIG. 2, on the top of the dispenser, and rotating said knob (7) to either the left or right. Once the knob (7) has been turned to the proper position for aligning the rollers (2) over the chosen holder (4), further movement of the knob (7) will be prevented by a stop plate (8). The knob (7) may be turned at any time, but only when the holder (18) with its rollers (2) is at the extreme top of the limit of its travel along the worm screw (3) is the holder (18) able to be turned to the position desired.

Figure 2:
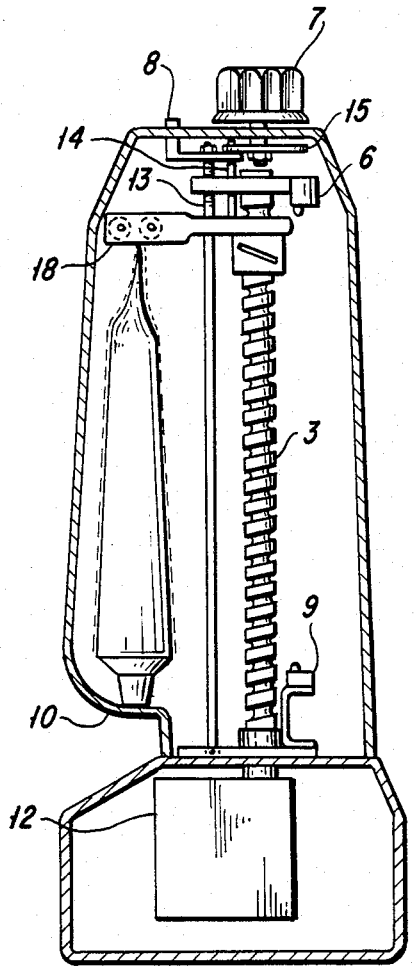
FIG. 2 is a side view, showing the internal portions, of this invention.
Figure 3:
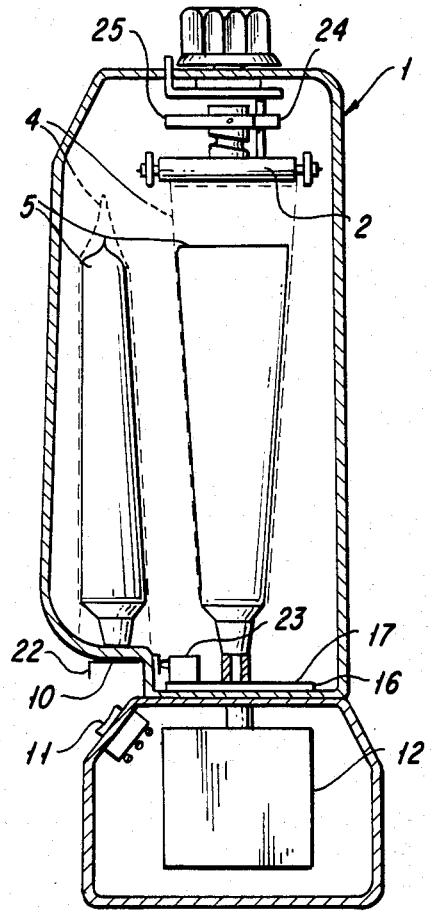
FIG. 3 is a front view, showing the internal portions, of this invention.

As shown in FIG. 2, the worm screw (3) and guide bar (13) control the travel of the holder (18) with its rollers (2). The guide bar (13) extends through a hole in the holder (18). When the rollers (2) have traveled to the bottom of the tube holder (4), the roller holder (18) will contact a reversing switch (9), which will cause the motor (12) to reverse its polarity and, when said motor (12) is actuated, cause the worm screw (3) to turn in a direction such that the holder (18) with its rollers (2) will move in an upward direction. This upward direction can also be accomplished at any time by pressing the rocker switch (11) in the appropriate direction. When the roller holder (18) reaches the upper extremity of its travel, it contacts another reversing switch (6), which will cause the motor (12) to reverse its polarity and, when said motor (12) is actuated, cause the worm screw (3) to turn in a direction such that the holder (18) with its rollers (2) will move in the downward direction. When the holder (18) reaches the upper extremity of its travel, a locating pin (14), being pushed upward by the holder (18), is inserted into holes in the stop plate (8) and the rotating plate (15), which is mounted on the knob (7). At this time and only in this position are the stop plate (8) and the rotating plate (15) joined, and only in this position, may the holder (18) with its rollers (2) be rotated to the other position.

FIG. 3 shows the two tube holders (4) with their tubes (5), together with the output location (10) for dispensing the paste. There is a spring loaded flap (22) which is pushed aside by the tooth brush to contact a switch (23), which actuates the motor (12) causing the worm screw (3) to drive the holder (18) downward and the rollers (2) to compress the tube holder (4) with its tube (5) to extract paste and place it on the brush. FIG. 3 also shows the base plate (16) and the bearing (17) which rotates around the base of the worm screw (3). Also shown is the top plate (24) and its bearing (25).

Mounted on the top plate (24) is the locating pin (14) and the top reversing switch (6). Protruding through the top plate (24) is the guide bar (13), which is connected to the stop plate (8) at the top and to the base plate (16) at the bottom. Since the guide bar (13) is connected to the stop plate (8), when the locating pin (14) engages the holes in the stop plate (8) and the rotating plate (15), the operator may turn the knob (7) and rotate the holder (18) with its rollers (2) to the desired position. The bearings (17,25) allow the holder (18) to be rotated, without turning the worm screw (3).

It is to be understood that the invention is not limited to the illustrations described and shown herein, which are deemed to be merely illustrative of the best modes of carrying out the invention, and which are susceptible to modification of form, materials, size, number of tubes, arrangement of parts and details of operation. The invention rather is intended to encompass all such modifications which are within its spirit and scope as defined by the claims.

What is claimed is:

1. An apparatus for dispensing toothpaste or like contents from one of a multiplicity of collapsible tubes onto a toothbrush or other object which comprises:

a housing;

reversible motor means located within said housing for selectively rotating a threaded output shaft means in a clockwise or counterclockwise manner;

means for powering said motor means located within said housing;

threaded output shaft means directly associated with said motor means for moving a rotatable roller means linearly in a first direction and a second direction on said threaded output shaft means, as said shaft means moves in a clockwise and counterclockwise manner;

rotatable roller means associated with said shaft means so as to move on said shaft means as said shaft means rotates;

outlet means associated with said housing through which said paste from said collapsible tube is expelled;

closure member movable across said outlet means and reciprocally movable across said outlet means between a first position where said outlet is closed to a second position where said outlet is open;

first switch means associated with said motor means for actuating said motor means by said power means so as to rotate said shaft means;

a toothbrush for moving said closure member from said first position to said second position wherein said closure member directly engages said first switch means so as to actuate said motor means such that said roller means moves on said shaft means and said toothpaste is applied to said toothbrush;

second switch means associated with said motor means for actuating said motor means by said power means so as to selectively rotate said shaft means in a clockwise and counterclockwise manner upon actuation of said motor means such that said roller means moves in a first direction and a second direction on said shaft means;

third switch means associated with said power means and actuated by said roller means for reversing the polarity of said motor means when said roller means has moved in said first direction so as to completely dispense the contents of said collapsible tube;

fourth switch means associated with said power means and actuated by said roller means for reversing the polarity of said motor means when said roller means has moved in said second direction so as to be at the extremity of its starting position;

a multiplicity of tube holding means located within said housing;

a selector means to rotate said roller means to the appropriate position to operate on a particular tube holding means;

an indicator means to inform the operator when said roller means has been moved by said selector means to said appropriate position to operate on a particular tube holding means;

a connector means to provide linkage between said selector means and said roller means only when said roller means is at the extremity of its starting position;

a bearings means which allows said roller means to be rotated without turning said shaft means.

2. An apparatus according to claim 1 wherein said multiplicity of tube holding means comprises two tube holding means.

* * * * *